US012577748B2

(12) United States Patent
Zhang et al.

(10) Patent No.: US 12,577,748 B2
(45) Date of Patent: Mar. 17, 2026

(54) METHOD AND DEVICE FOR OPTIMIZING REGULATION OF RESERVOIR SEDIMENT DISCHARGING BASED ON ASYNCHRONOUS PROPAGATION CHARACTERISTIC BETWEEN FLOOD PEAK AND SEDIMENT PEAK

(71) Applicant: China Institute of Water Resources and Hydropower Research, Beijing (CN)

(72) Inventors: Bangwen Zhang, Beijing (CN); Anjun Deng, Beijing (CN); Dangwei Wang, Beijing (CN); Wen Lu, Beijing (CN); Hongling Shi, Beijing (CN); Huifang Liu, Beijing (CN); Hejing Zhao, Beijing (CN); Qin Lu, Beijing (CN); Zhandi Dong, Beijing (CN); Maohua Le, Beijing (CN); Yiqin Xie, Beijing (CN); Ke Ni, Beijing (CN)

(73) Assignee: China Institute of Water Resources and Hydropower Research, Beijing (CN)

( * ) Notice: Subject to any disclaimer, the term of this patent is extended or adjusted under 35 U.S.C. 154(b) by 296 days.

(21) Appl. No.: 18/505,082

(22) Filed: Nov. 8, 2023

(65) Prior Publication Data

US 2024/0287751 A1 Aug. 29, 2024

(30) Foreign Application Priority Data

Feb. 24, 2023 (CN) ..... 202310213774.1

(51) Int. Cl.
*G06Q 10/04* (2023.01)
*E02B 8/02* (2006.01)

(52) U.S. Cl.
CPC ..... *E02B 8/02* (2013.01)

(58) Field of Classification Search
CPC .... E02B 8/02; G06Q 10/06312; G06Q 10/04; G06Q 10/06313; G06Q 50/06
See application file for complete search history.

(56) References Cited

U.S. PATENT DOCUMENTS 3,832,854 A * 9/1974 Metts ..... G05D 9/02 137/577
4,310,262 A * 1/1982 Calza ..... E02B 7/005 405/91

(Continued)

*Primary Examiner* — Edwin J Toledo-Duran

(57) ABSTRACT

A method and device for optimizing regulation of reservoir sediment discharging, comprises: determining a relation curve between a dam front water depth and a reservoir capacity; determining a time length by which a sediment peak is propagated to the front of a dam and a time length by which the sediment peak lags behind a flood peak at the front of the dam based on the relation curve and the hydrologic features; determining another relation curve between a sediment peak attenuation rate and a sediment concentration of the sediment peak, and a time length by which the sediment peak subjected to a man-made flood wave is propagated to the front of the dam; and acquiring a real-time sediment concentration, and generating the man-made flood wave based on the time length by which the sediment peak is propagated to the front of the dam and the another relation curve.

13 Claims, 4 Drawing Sheets

(56) References Cited

U.S. PATENT DOCUMENTS

| | | | | |
|---|---|---|---|---|
| 5,032,038 | A * | 7/1991 | Lemperiere | E02B 8/06 405/114 |
| 5,061,118 | A * | 10/1991 | Lemperiere | E02B 7/16 405/114 |
| 6,126,362 | A * | 10/2000 | Carter | E02B 3/108 405/91 |
| 9,213,994 | B2 * | 12/2015 | Green | G06Q 90/00 |
| 10,094,091 | B1 * | 10/2018 | Tesvich | E02F 3/9293 |
| 2003/0118406 | A1 * | 6/2003 | Davis | E02B 8/085 405/84 |
| 2006/0122794 | A1 * | 6/2006 | Sprague | G06Q 50/26 702/32 |
| 2011/0311312 | A1 * | 12/2011 | Bouchard | E02B 3/10 405/270 |
| 2014/0229420 | A1 * | 8/2014 | Green | G06Q 50/16 706/52 |
| 2020/0071897 | A1 * | 3/2020 | Parker | E02F 9/2054 |
| 2021/0262185 | A1 * | 8/2021 | Adler | E02B 7/16 |
| 2023/0002991 | A1 * | 1/2023 | Chen | E02B 3/00 |

* cited by examiner

METHOD AND DEVICE FOR OPTIMIZING REGULATION OF RESERVOIR SEDIMENT DISCHARGING BASED ON ASYNCHRONOUS PROPAGATION CHARACTERISTIC BETWEEN FLOOD PEAK AND SEDIMENT PEAK

CROSS-REFERENCE TO RELATED APPLICATIONS

This application claims the priority of Chinese Patent Application CN 202310213774.1, entitled "Method and Device for Optimizing Regulation of Reservoir Sediment Discharging Under Human Intervention" and filed on Feb. 24, 2023, the entirety of which is incorporated herein by reference.

FIELD OF THE INVENTION

The present disclosure relates to the technical field of hydraulic engineering, and in particular, to a method for optimizing regulation of reservoir sediment discharging based on an asynchronous propagation characteristic between a flood peak and a sediment peak, a device for the same, an electronic device, and a storage medium.

BACKGROUND OF THE INVENTION

In order to make full use of water resources and gain better social and economic benefits, the Three Georges Reservoir adopts approaches of optimizing regulation such as floating a flood control level, dispatching medium-scale and small-scale floods, storing water in advance of flood recession, and the like. However, these approaches of optimizing regulation may result in elevation of an average water level of a reservoir in the flood season compared with a designed water level, thereby aggravating reservoir sedimentation.

A sediment peak of flood in a natural river propagates downstream in sync with a flood peak. However, after the reservoir is built, an increase of the water depth speeds up a propagation velocity of the flood peak and slows down a propagation velocity of the sediment peak, so that a phenomenon that propagation of the sediment peak gradually lags behind propagation of the flood peak appears, which is referred to as an asynchronous propagation characteristic between the flood peak and the sediment peak. The asynchronous propagation characteristic between the flood peak and the sediment peak makes it difficult to discharge sediment out of the reservoir in time after the sediment carried by the flood enters into the reservoir.

In order to alleviate this situation, during sediment discharging in the flood season, the Three Georges Reservoir uses a difference between a propagation time length of the flood peak and a propagation time length of the sediment peak in the reservoir to implement a sediment discharging regulation mode of "weakening a flood peak by the reservoir while the flood peak is rising the water level, and increasing a sediment discharge amount while the flood peak is lowering the water level", so as to improve the sediment discharging efficiency of the reservoir.

However, an existing regulation method of a reservoir in which sediment discharging depends upon the sediment peak mainly concerns the propagation characteristic between the flood peak and the sediment peak within the area of the reservoir, but fails to consider the influence of actions of upper-stream cascade reservoirs on the propagation characteristic between the flood peak and the sediment peak, so that the effect of optimizing regulation of sediment discharging is limited.

SUMMARY OF THE INVENTION

The present disclosure provides a method for optimizing regulation of reservoir sediment discharging based on an asynchronous propagation characteristic between a flood peak and a sediment peak, which solves the problem that the effect of optimizing regulation of sediment discharging is limited as the existing regulation method for a reservoir in which sediment discharging depends upon a sediment peak fails to consider the influence of actions of upper-stream cascade reservoirs on the propagation characteristic between the flood peak and the sediment peak.

According to a first aspect, the present disclosure provides a method for optimizing regulation of reservoir sediment discharging based on an asynchronous propagation characteristic between a flood peak and a sediment peak, comprising:

- collecting hydrologic features and measured topographic data of tail area of a reservoir;
- determining a relation curve between a dam front water depth and a reservoir capacity based on the measured topographic data;
- determining a time length by which a sediment peak entering in the reservoir is propagated to the front of a dam and a time length by which the sediment peak lags behind the flood peak at the front of the dam of the reservoir based on the relation curve between the dam front water depth and the reservoir capacity as well as the hydrologic features;
- determining a relation curve between a sediment peak attenuation rate corresponding to the hydrologic features and a sediment concentration of the sediment peak entering in the reservoir, and a time length by which the sediment peak subjected to a man-made flood wave is propagated to the front of the dam;
- acquiring a real-time sediment concentration of the sediment peak entering in the reservoir in response to an optimizing regulation instruction, and generating the man-made flood wave based on the time length by which the sediment peak entering in the reservoir is propagated to the front of the dam and the relation curve between the sediment peak attenuation rate and the sediment concentration of the sediment peak entering in the reservoir;
- determining a lag time length based on the time length by which the sediment peak lags behind the flood peak at the front of the dam of the reservoir, the time length by which the sediment peak subjected to the man-made flood wave is propagated to the front of the dam, and the sediment peak attenuation rate; and
- discharging the man-made flood wave at a time that is after passing of the flood peak by the lag time length.

Optionally, determining a time length by which a sediment peak entering in the reservoir is propagated to the front of a dam and a time length by which the sediment peak lags behind the flood peak at the front of the dam of the reservoir based on the relation curve between the dam front water depth and the reservoir capacity as well as the hydrologic features includes:

- determining a time length by which the sediment peak lags behind the flood peak at tail area of the reservoir, a time length by which the flood peak entering in the reservoir propagates to the front of the dam, and a time length by which the sediment peak entering in the reservoir is propagated to the front of the dam according to the hydrologic features and the relation curve between the dam front water depth and the reservoir capacity; and determining the time length by which the sediment peak lags behind the flood peak at the front of the dam of the reservoir based on the time length by which the sediment peak lags behind the flood peak at tail area of the reservoir, the time length by which the flood peak entering in the reservoir propagates to the front of the dam, and the time length by which the sediment peak entering in the reservoir is propagated to the front of the dam in combination with an empirical formula regarding the time length by which the sediment peak lags behind the flood peak at the front of the dam of the reservoir.

Optionally, the hydrologic features include: a time at which a flood peak entering in the reservoir appears, a flow amount of the flood peak entering in the reservoir, a dam front water depth, a dam front water level elevation, a dam front bottom elevation, a time at which a sediment peak entering in the reservoir appears, a sediment concentration of the sediment peak entering in the reservoir, and a water surface length of the reservoir; and determining a time length by which the sediment peak lags behind the flood peak at tail area of the reservoir, a time length by which the flood peak entering in the reservoir propagates to the front of the dam, and a time length by which the sediment peak entering in the reservoir is propagated to the front of the dam according to the hydrologic features and the relation curve between the dam front water depth and the reservoir capacity includes:

determining the time length by which the sediment peak lags behind the flood peak at tail area of the reservoir based on a difference between the time at which the flood peak entering in the reservoir appears and the time at which the sediment peak entering in the reservoir appears;

determining the time length by which the flood peak entering in the reservoir propagates to the front of the dam based on the water surface length of the reservoir, the dam front water level elevation and the dam front bottom elevation in combination with a preset empirical formula regarding a time length to the front of the dam; and determining the time length by which the sediment peak entering in the reservoir is propagated to the front of the dam based on the time at which the sediment peak entering in the reservoir appears, the sediment concentration of the sediment peak entering in the reservoir, and the dam front water depth in combination with the relation curve between the dam front water depth and the reservoir capacity.

Optionally, determining the time length by which the flood peak entering in the reservoir propagates to the front of the dam based on the water surface length of the reservoir, the dam front water level elevation and the dam front bottom elevation in combination with the preset empirical formula regarding a time length to the front of the dam includes:

determining the dam front water depth based on a difference between the dam front water level elevation and the dam front bottom elevation; and determining the time length by which the flood peak entering in the reservoir propagates to the front of the dam based on the dam front water depth and the water surface length of the reservoir in combination with the empirical formula regarding a time length to the front of the dam.

Optionally, the hydrologic features further include: a sediment content of a sediment peak of a hydrologic station at tail area of the reservoir, a sediment content of the sediment peak of a hydrologic station in front of the dam, a sediment concentration of the sediment peak entering in the reservoir, a reservoir capacity, and a discharged flow amount of upper-stream cascade reservoirs; and determining the relation curve between a sediment peak attenuation rate corresponding to the hydrologic features and a sediment concentration of the sediment peak entering in the reservoir, and determining the time length by which the sediment peak subjected to the man-made flood wave is propagated to the front of the dam includes:

determining a sediment peak attenuation rate based on the sediment content of the sediment peak of the hydrologic station at tail area of the reservoir and the sediment content of the sediment peak of the hydrologic station in front of the dam;

determining a relation curve between the sediment peak attenuation rate and the sediment concentration of the sediment peak entering in the reservoir based on a plurality of sediment peak attenuation rates and a plurality of sediment concentration of the sediment peak entering in the reservoir; and determining a time length by which the sediment peak subjected to the man-made flood wave is propagated to the front of the dam based on a ratio of the reservoir capacity to the discharged flow amount of upper-stream cascade reservoirs.

Optionally, acquiring a real-time sediment concentration of the sediment peak entering in the reservoir in response to an optimizing regulation instruction, and generating the man-made flood wave based on the time length by which the sediment peak entering in the reservoir is propagated to the front of the dam and the relation curve between the sediment peak attenuation rate and the sediment concentration of the sediment peak entering in the reservoir includes:

determining an attenuation degree of the sediment peak under a real-time sediment concentration of the sediment peak entering in the reservoir based on the time length by which the sediment peak entering in the reservoir is propagated to the front of the dam and the relation curve between the sediment peak attenuation rate and the sediment concentration of the sediment peak entering in the reservoir; and generating the man-made flood wave based on the attenuation degree of the sediment peak.

According to a second aspect, the present disclosure provides a device for optimizing regulation of reservoir sediment discharging based on an asynchronous propagation characteristic between a flood peak and a sediment peak, comprising:

a collecting module, which is configured to collect hydrologic features and measured topographic data of tail area of a reservoir;

a relation curve determining module, which is configured to determine a relation curve between a dam front water depth and a reservoir capacity based on the measured topographic data;

a reservoir lag time length determining module, which is configured to determine a time length by which a sediment peak entering in the reservoir is propagated to the front of a dam and a time length by which the sediment peak lags behind a flood peak at the front of the dam of the reservoir based on the relation curve between the dam front water depth and the reservoir capacity as well as the hydrologic features;

a man-made flood wave propagation time length determining module, which is configured to determine a relation curve between a sediment peak attenuation rate corresponding to the hydrologic features and a sediment concentration of the sediment peak entering in the reservoir, and determine a time length by which the sediment peak subjected to a man-made flood wave is propagated to the front of the dam;

a responding module, which is configured to acquire a real-time sediment concentration of the sediment peak entering in the reservoir in response to an optimizing regulation instruction, and generate the man-made flood wave based on the time length by which the sediment peak entering in the reservoir is propagated to the front of the dam and the relation curve between the sediment peak attenuation rate and the sediment concentration of the sediment peak entering in the reservoir;

a lag time length determining module, which is configured to determine a lag time length based on the time length by which the sediment peak lags behind the flood peak at the front of the dam of the reservoir, the time length by which the sediment peak subjected to the man-made flood wave is propagated to the front of the dam, and the sediment peak attenuation rate; and a discharging module, which is configured to discharge the man-made flood wave at a time that is after passing of the flood peak by the lag time length.

Optionally, the reservoir lag time length determining module includes:

a time length determining sub-module, which is configured to determine a time length by which the sediment peak lags behind the flood peak at tail area of the reservoir, a time length by which a flood peak entering in the reservoir propagates to the front of the dam, and a time length by which the sediment peak entering in the reservoir is propagated to the front of the dam according to the hydrologic features and the relation curve between the dam front water depth and the reservoir capacity; and a determining sub-module targeting at a time length by which the sediment peak lags behind the flood peak at the front of the dam of the reservoir, which is configured to determine a time length by which the sediment peak lags behind the flood peak at the front of the dam of the reservoir based on the time length by which the sediment peak lags behind the flood peak at tail area of the reservoir, the time length by which the flood peak entering in the reservoir propagates to the front of the dam, and the time length by which the sediment peak entering in the reservoir is propagated to the front of the dam.

According to a third aspect, the present disclosure provides an electronic device, which includes a processor and a memory, wherein the memory stores a computer readable instruction, wherein the computer readable instruction, when executed by the processor, carries out steps of the method according to the first aspect.

According to a fourth aspect, the present disclosure provides a storage medium which stores a computer program thereon, and the computer program, when executed by a processor, implements steps of the method according to the first aspect.

According to a fifth aspect, the present disclosure provides a computer program product, which, when executed by a processor, implements steps of the method according to the first aspect.

It can be seen from the above technical solutions that the present disclosure has the following advantages.

The present disclosure provides a method and device for optimizing regulation of reservoir sediment discharging based on an asynchronous propagation characteristic between a flood peak and a sediment peak, comprising: collecting hydrologic features and measured topographic data of tail area of a reservoir; determining a relation curve between the dam front water depth and the reservoir capacity based on the measured topographic data; determining a time length by which a sediment peak entering in the reservoir is propagated to the front of the dam and a time length by which the sediment peak lags behind a flood peak at the front of the dam of the reservoir based on the relation curve between the dam front water depth and the reservoir capacity as well as the hydrologic features; determining a relation curve between a sediment peak attenuation rate corresponding to the hydrologic features and a sediment concentration of the sediment peak entering in the reservoir, and a time length by which the sediment peak subjected to a man-made flood wave is propagated to the front of the dam is determined; acquiring a real-time sediment concentration of the sediment peak entering in the reservoir in response to an optimizing regulation instruction, and generating the man-made flood wave based on the time length by which the sediment peak entering in the reservoir is propagated to the front of the dam and the relation curve between the sediment peak attenuation rate and the sediment concentration of the sediment peak entering in the reservoir; determining a lag time length based on the time length by which the sediment peak lags behind the flood peak at the front of the dam of the reservoir, the time length by which the sediment peak subjected to the man-made flood wave is propagated to the front of the dam, and the sediment peak attenuation rate; and discharging the man-made flood wave at a time that is after passing of the flood peak by the lag time length. A discharged flow amount of water is increased by using the upper-stream cascade reservoirs, that is, the man-made flood wave changes the propagation time length and the attenuation rate of the lagged sediment peak in the reservoir area, thereby further optimizing the effect of optimizing regulation of sediment discharging.

BRIEF DESCRIPTION OF THE DRAWINGS

In order to better explain embodiments of the present disclosure or technical solutions in existing technologies, drawings required for describing the embodiments or the existing technologies are introduced briefly below. Apparently, the drawings in the following description are only for exemplifying some embodiments of the present disclosure, and for a person of ordinary skills in the art, other drawings may also be obtained based on these drawings without making creative efforts.

DETAILED DESCRIPTION OF THE EMBODIMENTS

Embodiments of the present disclosure provide a method for optimizing regulation of reservoir sediment discharging based on an asynchronous propagation characteristic between a flood peak and a sediment peak, which solves the problem that the effect of optimizing regulation of sediment discharging is limited as the existing regulation method for a reservoir in which sediment discharging depends upon a sediment peak fails to consider the influence of actions of upper-stream cascade reservoirs on the propagation characteristic between the flood peak and the sediment peak.

In order to make the objectives, features, and advantages of the present disclosure clearer and easier to understand, technical solutions in embodiments of the present disclosure will be described in a clear and complete manner with reference to drawings in the embodiments of the present application. Apparently, the embodiments described below are only some, rather than all, of the embodiments of the present disclosure. Based on the embodiments in the present disclosure, all other embodiments, obtained by a person of ordinary skills in the art without making creative efforts, should fall into the protection scope of the present disclosure.

Figure 1:
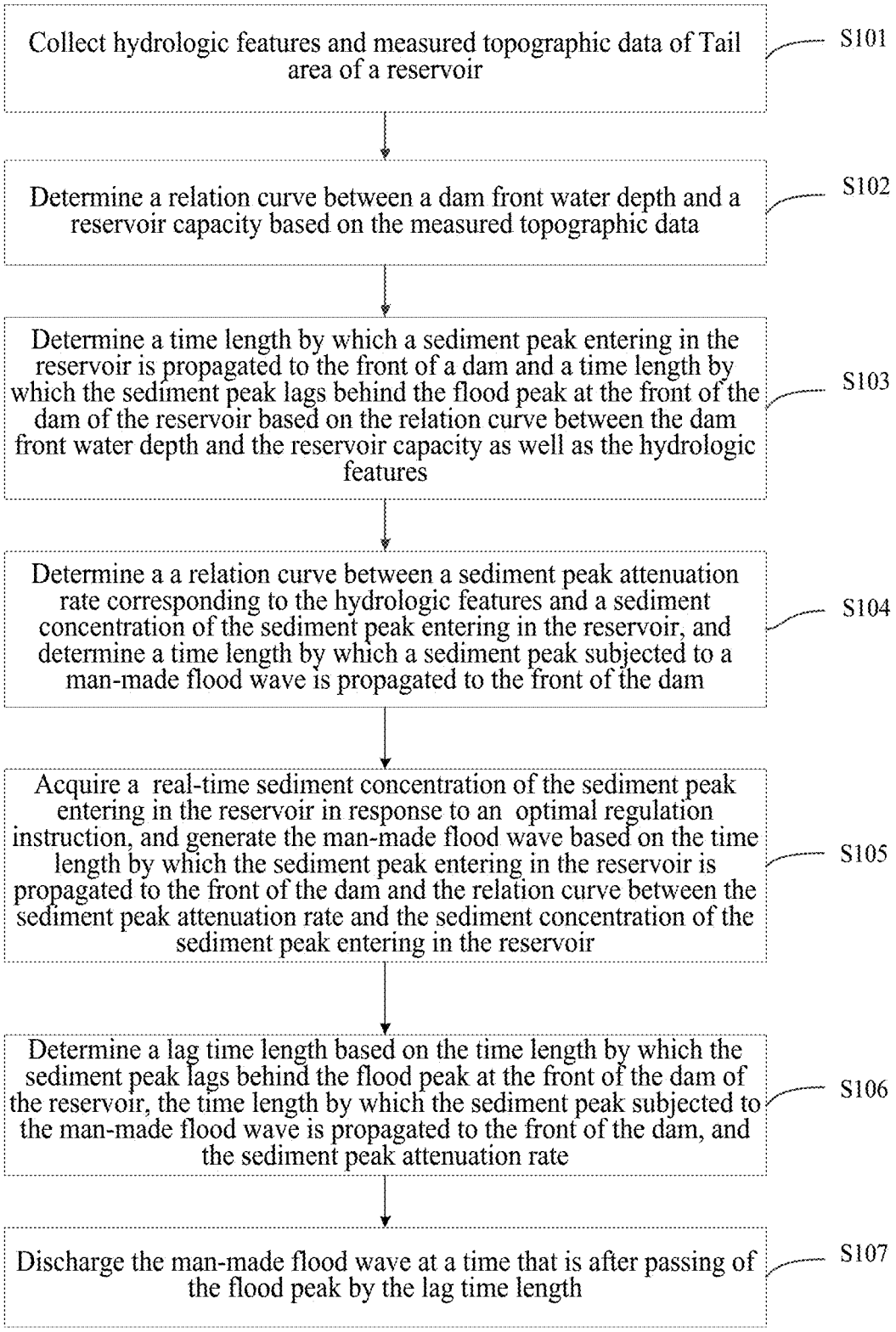
FIG. 1 is a flowchart of a method for optimizing regulation of reservoir sediment discharging based on an asynchronous propagation characteristic between a flood peak and a sediment peak according to Embodiment One of the present disclosure.

For Embodiment One, please refer to FIG. 1. FIG. 1 is a flowchart of a method for optimizing regulation of reservoir sediment discharging based on an asynchronous propagation characteristic between a flood peak and a sediment peak according to Embodiment One of the present disclosure, and the method includes steps S101 to S107.

At step S101, hydrologic features and measured topographic data are collected;

At step S102, a relation curve between a dam front water depth and a reservoir capacity is determined based on the measured topographic data;

At step S103, a time length by which a sediment peak entering in the reservoir is propagated to the front of a dam and a time length by which the sediment peak lags behind the flood peak at the front of the dam of the reservoir are determined according to the relation curve between the dam front water depth and the reservoir capacity as well as the hydrologic features;

At step S104, a relation curve between a sediment peak attenuation rate corresponding to the hydrologic features and a sediment concentration of the sediment peak entering in the reservoir is determined, and a time length by which the sediment peak subjected to a man-made flood wave is propagated to the front of the dam is determined;

At step S105, a real-time sediment concentration of the sediment peak entering in the reservoir is acquired in response to an optimizing regulation instruction, and the man-made flood wave is generated based on the time length by which the sediment peak entering in the reservoir is propagated to the front of the dam and the relation curve between the sediment peak attenuation rate and the sediment concentration of the sediment peak entering in the reservoir;

At step S106, a lag time length is determined based on the time length by which the sediment peak lags behind the flood peak at the front of the dam of the reservoir, the time length by which the sediment peak subjected to the man-made flood wave is propagated to the front of the dam, and the sediment peak attenuation rate; and At step S107, the man-made flood wave is discharged at a time that is after passing of the flood peak by the lag time length.

According to the method for optimizing regulation of reservoir sediment discharging based on an asynchronous propagation characteristic between a flood peak and a sediment peak provided by the present embodiment, hydrologic features and measured topographic data are collected; a relation curve between a dam front water depth and a reservoir capacity is determined based on the measured topographic data; a time length by which a sediment peak entering in the reservoir is propagated to the front of a dam and a time length by which the sediment peak lags behind the flood peak at the front of the dam of the reservoir are determined according to the relation curve between the dam front water depth and the reservoir capacity as well as the hydrologic features; a relation curve between a sediment peak attenuation rate corresponding to the hydrologic features and a sediment concentration of the sediment peak entering in the reservoir is determined, and a time length by which the sediment peak subjected to man-made flood wave is propagated to the front of the dam is determined; a real-time sediment concentration of the sediment peak entering in the reservoir is acquired in response to an optimizing regulation instruction, and the man-made flood wave is generated based on the time length by which the sediment peak entering in the reservoir is propagated to the front of the dam and the relation curve between the sediment peak attenuation rate and the sediment concentration of the sediment peak entering in the reservoir; a lag time length is determined based on the time length by which the sediment peak lags behind the flood peak at the front of the dam of the reservoir, the time length by which the sediment peak subjected to the man-made flood wave is propagated to the front of the dam, and the sediment peak attenuation rate; and the man-made flood wave is discharged at a time that is after passing of the flood peak by the lag time length. A discharged flow amount of water is increased by using the upper-stream cascade reservoirs, that is, the man-made flood wave changes the propagation time length and the attenuation rate of the lagged sediment peak in the reservoir area, thereby further optimizing the effect of optimizing regulation of sediment discharging.

Figure 2:
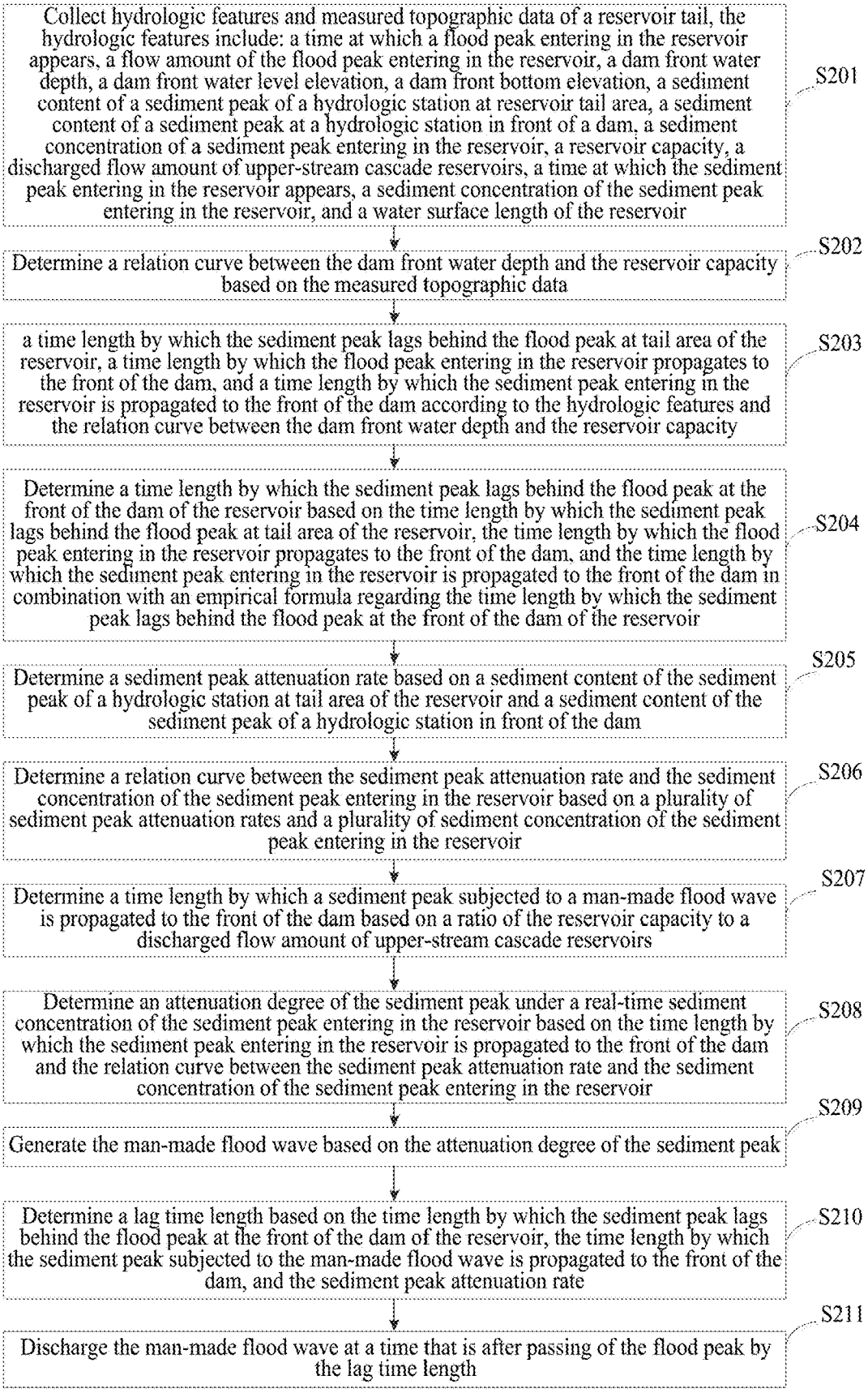
FIG. 2 is a flowchart of a method for optimizing regulation of reservoir sediment discharging based on an asynchronous propagation characteristic between a flood peak and a sediment peak according to Embodiment Two of the present disclosure.

For Embodiment Two, please refer to FIG. 2. FIG. 2 is a flowchart of a method for optimizing regulation of reservoir sediment discharging based on an asynchronous propagation characteristic between a flood peak and a sediment peak according to Embodiment Two of the present disclosure. The method includes steps S201 to S211.

At step S201, hydrologic features and measured topographic data of tail area of a reservoir are collected, wherein the hydrologic features include: a time at which a flood peak entering in the reservoir appears, a flow amount of the flood peak entering in the reservoir, a dam front water depth, a dam front water level elevation, a dam front bottom elevation, a sediment content of a sediment peak of a hydrologic station at reservoir tail area, a sediment content of a sediment peak at a hydrologic station in front of a dam, a sediment concentration of a sediment peak entering in the reservoir, a reservoir capacity, a discharged flow amount of upper-stream cascade reservoirs, a time at which the sediment peak entering in the reservoir appears, a sediment concentration of the sediment peak entering in the reservoir, and a water surface length of the reservoir.

At step S202, a relation curve between the dam front water depth and the reservoir capacity is determined based on the measured topographic data.

At step S203, a time length by which the sediment peak lags behind the flood peak at tail area of the reservoir, a time length by which the flood peak entering in the reservoir propagates to the front of the dam, and a time length by which the sediment peak entering in the reservoir is propagated to the front of the dam are determined according to the hydrologic features and the relation curve between the dam front water depth and the reservoir capacity.

Specifically, the following steps are included:

the time length by which the sediment peak lags behind the flood peak at tail area of the reservoir is determined based on a difference between the time at which the flood peak entering in the reservoir appears and the time at which the sediment peak entering in the reservoir appears;

the time length by which the flood peak entering in the reservoir propagates to the front of the dam is determined based on the water surface length of the reservoir, the dam front water level elevation and the dam front bottom elevation in combination with a preset empirical formula regarding a time length to the front of the dam; and the time length by which the sediment peak entering in the reservoir is propagated to the front of the dam is determined based on the time at which the sediment peak entering in the reservoir appears, the sediment concentration of the sediment peak entering in the reservoir, and the dam front water depth in combination with the relation curve between the dam front water depth and the reservoir capacity.

In the present embodiment, the time length by which the sediment peak lags behind the flood peak at tail area of the reservoir is the difference between the time at which the flood peak entering in the reservoir appears and the time at which the sediment peak entering in the reservoir appears, and a formula thereof is expressed as T0=tf0−ts0, in which T0 is the time length by which the sediment peak lags behind the flood peak at tail area of the reservoir, tf0 is the time at which the flood peak entering in the reservoir appears, ts0 is the time at which the sediment peak entering in the reservoir appears.

Meanwhile, a time length by which the sediment peak entering in the reservoir is propagated to the front of the dam may be determined based on the water surface length of the reservoir and an average velocity of water flow of the reservoir, and may also be determined based on the flow amount of the flood peak entering in the reservoir and the reservoir capacity corresponding to the dam front water depth.

In specific implementation, the reservoir capacity corresponding to the dam front water depth is determined according to the relation curve between the dam front water depth and the reservoir capacity. It should be noted that, the sediment moves with the water flow, and the sediment peak propagates at the average velocity of the water flow of the reservoir. Therefore, the time length by which the sediment peak entering in the reservoir is propagated to the front of the dam may be obtained by calculating with the following calculation formula:

$$Ts = L/U = AL/AU = V/Q,$$

in which Ts is the time length by which the flood peak entering in the reservoir propagates to the front of the dam, L is the water surface length of the reservoir, U is the average velocity of the water flow of the reservoir, A is a sectional area of the reservoir, Q is the sediment concentration of the sediment peak entering in the reservoir.

In an alternative embodiment, the time length by which the flood peak entering in the reservoir propagates to the front of the dam being determined based on the water surface length of the reservoir, the dam front water level elevation and the dam front bottom elevation in combination with a preset empirical formula regarding a time length to the front of the dam includes:

determining the dam front water depth based on a difference between the dam front water level elevation and the dam front bottom elevation; and determining the time length by which the flood peak entering in the reservoir propagates to the front of the dam based on the dam front water depth and the water surface length of the reservoir in combination with the empirical formula regarding a time length to the front of the dam.

In the present embodiment, a formula for determining the dam front water depth based on the dam front water level elevation and the dam front bottom elevation is expressed as: h=Wh−Bh. Then, a propagation velocity of the flood peak entering in the reservoir is determined according to the dam front water depth. It should be noted that, the flood peak propagates in the form of a wave, and a calculation formula of the propagation velocity of the flood peak is expressed as: Cd=U+(gh)½. For the reservoir, since the average velocity of the water flow of the reservoir is far less than (gh)½, the magnitude of the propagation velocity of the flood peak approximates (gh)½. Finally, the time length by which the flood peak entering in the reservoir propagates to the front of the dam is determined based on the dam front water depth and the water surface length of the reservoir, with a calculation formula thereof being expressed as: Tf=L/Cd, wherein Tf is the time length by which the flood peak entering in the reservoir propagates to the front of the dam, h is the dam front water depth, Wh is the dam front water level elevation, Bh is the dam front bottom elevation of the reservoir, Cd is the propagation velocity of the flood peak entering in the reservoir, and g is the acceleration of gravity.

At step S204, a time length by which the sediment peak lags behind the flood peak at the front of the dam of the reservoir is determined based on the time length by which the sediment peak lags behind the flood peak at tail area of the reservoir, the time length by which the flood peak entering in the reservoir propagates to the front of the dam, and the time length by which the sediment peak entering in the reservoir is propagated to the front of the dam in combination with an empirical formula regarding the time length by which the sediment peak lags behind the flood peak at the front of the dam of the reservoir.

The time length by which the sediment peak lags behind the flood peak at the front of the dam of the reservoir is obtained by calculating with the following calculation formula:

$$\Delta T = T0 + (Ts - Tf) = V/Q - L/(gh)1/2,$$

in which ΔT is the time length by which the sediment peak lags behind the flood peak at the front of the dam of the reservoir.

In the present embodiment, the time length by which the sediment peak lags behind the flood peak at the front of the dam of the reservoir is calculated from the perspective of the motion law of the sediment and the reservoir regulation optimization technologies, and based on the propagation laws of the flood and the sediment from the upper stream to the lower stream of reservoirs, which provides theoretical support for joint regulation of water and sediment among the reservoirs.

At step S205, a sediment peak attenuation rate is determined based on a sediment content of the sediment peak of a hydrologic station at tail area of the reservoir and a sediment content of the sediment peak of a hydrologic station in front of the dam.

In the present embodiment, a calculation formula of the sediment peak attenuation rate is as follows:

$$\alpha = (SSC\,\text{up} - SSC\,\text{down})/SSC\ \text{up} \times 100\%,$$

in which α is the sediment peak attenuation rate, SSCup is the sediment content of the sediment peak of the hydrologic station at tail area of the reservoir, and SSCdown is the sediment content of the sediment peak of the hydrologic station in front of the dam.

When α>0, it is indicated that the sediment content of the sediment peak of the hydrologic station in front of the dam is decreased relative to the sediment content of the sediment peak of the hydrologic station at tail area of the reservoir; and when α<0, it is indicated that the sediment content of the sediment peak of the hydrologic station in front of the dam is increased relative to the sediment content of the sediment peak of the hydrologic station at tail area of the reservoir.

At step S206, a relation curve between the sediment peak attenuation rate and the sediment concentration of the sediment peak entering in the reservoir is determined based on a plurality of sediment peak attenuation rates and a plurality of sediment concentration of the sediment peak entering in the reservoir.

In the present embodiment, the relation curve between the sediment peak attenuation rate and the sediment concentration of the sediment peak entering in the reservoir is determined based on collected data on the plurality of sediment peak attenuation rates and the plurality of sediment concentration of the sediment peak entering in the reservoir, so that an attenuation degree of the sediment peak at the front of the dam can be determined based on real-time data on a sediment concentration of the sediment peak entering in the reservoir.

At step S207, a time length by which the sediment peak subjected to a man-made flood wave is propagated to the front of the dam is determined based on a ratio of the reservoir capacity to a discharged flow amount of upper-stream cascade reservoirs.

In this case, a calculation formula regarding the time length by which the sediment peak subjected to the man-made flood wave is propagated to the front of the dam is as follows: Tu=V/Qu, in which Tu is the time length by which the sediment peak subjected to the man-made flood wave is propagated to the front of the dam, and Qu is an average velocity of water flow of the man-made flood wave.

In the present embodiment, in response to an optimizing regulation instruction manually input and by means of the optimizing regulation instruction, the man-made flood wave is formed. In this way, a lag property of the sediment peak relative to the flood peak is manually interfered, so as to reduce a distance between a sediment wave and a flood wave at the front of the dam.

At step S208, an attenuation degree of the sediment peak under a real-time sediment concentration of the sediment peak entering in the reservoir is determined based on the time length by which the sediment peak entering in the reservoir is propagated to the front of the dam and the relation curve between the sediment peak attenuation rate and the sediment concentration of the sediment peak entering in the reservoir.

At step S209, the man-made flood wave is generated based on the attenuation degree of the sediment peak.

At step S210, a lag time length is determined based on the time length by which the sediment peak lags behind the flood peak at the front of the dam of the reservoir, the time length by which the sediment peak subjected to the man-made flood wave is propagated to the front of the dam, and the sediment peak attenuation rate.

At step S211, the man-made flood wave is discharged at a time that is after passing of the flood peak by the lag time length.

In the present embodiment, when a sediment discharging regulation strategy of "weakening a flood peak by the reservoir while the flood peak is rising the water level, and increasing a sediment discharge amount while the flood peak is lowering the water level" is carried out by utilizing a difference between a propagation time of the flood peak and a propagation time of the sediment peak in a reservoir with a great water depth, a man-made flood wave is used to interfere the propagation property of the sediment peak in a process of discharging the flood and the sediment, so as to increase a propagation velocity of the sediment peak in the reservoir, reduce a time length by which the sediment peak is propagated to the front of the dam, and meanwhile lower an attenuation rate while the sediment peak is propagating to the front of the dam. In this way, a regulation method in which sediment discharging depends upon a sediment peak is used to improve the efficiency of reservoir sediment discharging. Therefore, it is possible to solve the problem happened to a mode of "storing clean water and discharging muddy water" in a reservoir with a great water depth that the efficiency of reservoir sediment discharging is low with respect to medium-scale and small-scale floods in the flood season.

Figure 3:
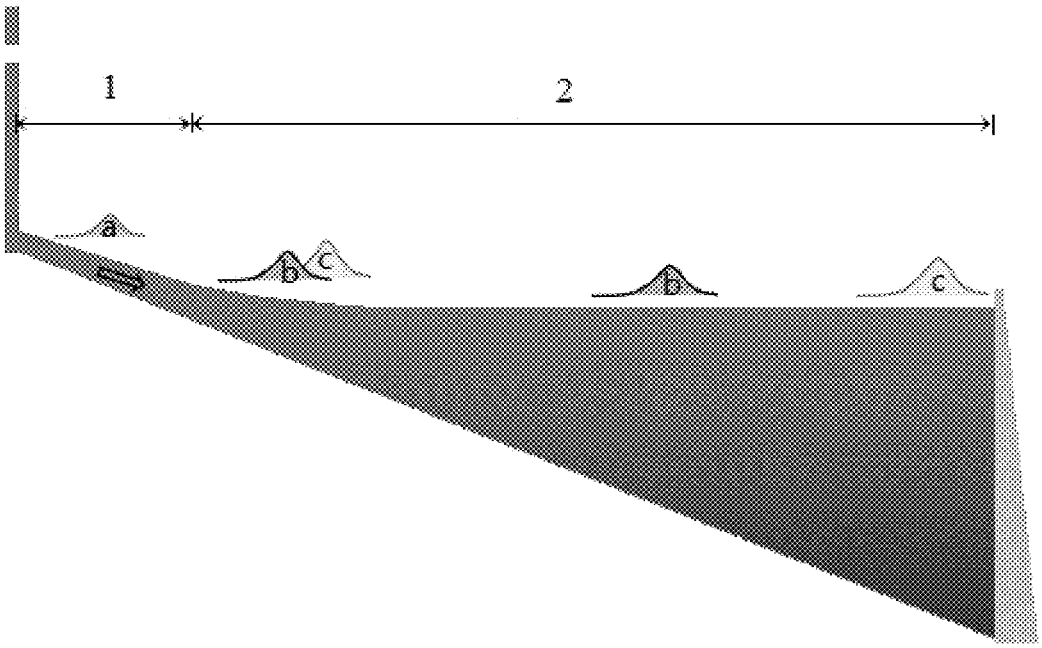
FIG. 3 is a schematic diagram of a principle of a method for optimizing regulation of reservoir sediment discharging based on an asynchronous propagation characteristic between a flood peak and a sediment peak according to an embodiment of the present disclosure.

Referring to FIG. 3, FIG. 3 is a schematic diagram of a principle of a method for optimizing regulation of reservoir sediment discharging according to an embodiment of the present disclosure, in which 1 refers to a natural river course, 2 refers to a reservoir, a refers to a man-made flood wave, b refers to a sediment wave, and c refers to a flood wave. After water is stored in the reservoir, the water depth thereof is increased so that dynamic characteristics of transport and movement between the water flow and the sediment are changed, i.e., the propagation velocity of the flood peak being increased while the propagation velocity of the sediment peak being decreased within the reservoir area, which makes the asynchronous propagation characteristic between the flood peak and the sediment peak more obvious. As a result, a distance between the sediment peak b and the flood peak c is greater at the front of the dam of the reservoir. That is, the closer the sediment peak and the flood peak approach the front of the dam, the further the sediment peak lags behind the flood peak. At this time, the upper-stream cascade reservoirs increase the discharged amount of water to form a man-made flood wave so as to reduce the distance between the sediment peak b and the flood peak c at the front of the dam, thereby optimizing the sediment discharging efficiency.

According to the method for optimizing regulation of reservoir sediment discharging based on an asynchronous propagation characteristic between a flood peak and a sediment peak provided by the present embodiment, hydrologic features and measured topographic data of tail area of a reservoir are collected; a relation curve between the dam front water depth and the reservoir capacity is determined based on the measured topographic data; a time length by which a sediment peak entering in the reservoir is propagated to the front of the dam and a time length by which the sediment peak lags behind a flood peak at the front of the dam of the reservoir are determined based on the relation curve between the dam front water depth and the reservoir capacity as well as the hydrologic features; a relation curve between a sediment peak attenuation rate corresponding to the hydrologic features and a sediment concentration of the sediment peak entering in the reservoir is determined, and a time length by which the sediment peak subjected to a man-made flood wave is propagated to the front of the dam is determined; a real-time sediment concentration of the sediment peak entering in the reservoir is acquired in response to an optimizing regulation instruction, and the man-made flood wave is generated based on the time length by which the sediment peak entering in the reservoir is propagated to the front of the dam and the relation curve between the sediment peak attenuation rate and the sediment concentration of the sediment peak entering in the reservoir; a lag time length is determined based on the time length by which the sediment peak lags behind the flood peak at the front of the dam of the reservoir, the time length by which the sediment peak subjected to the man-made flood wave is propagated to the front of the dam, and the sediment peak attenuation rate; and the man-made flood wave is discharged at a time that is after passing of the flood peak by the lag time length. A discharged flow amount of water is increased by using the upper-stream cascade reservoirs, that is, the man-made flood wave changes the propagation time length and the attenuation rate of the lagged sediment peak in the reservoir area, thereby further optimizing the effect of optimizing regulation of sediment discharging.

Figure 4:
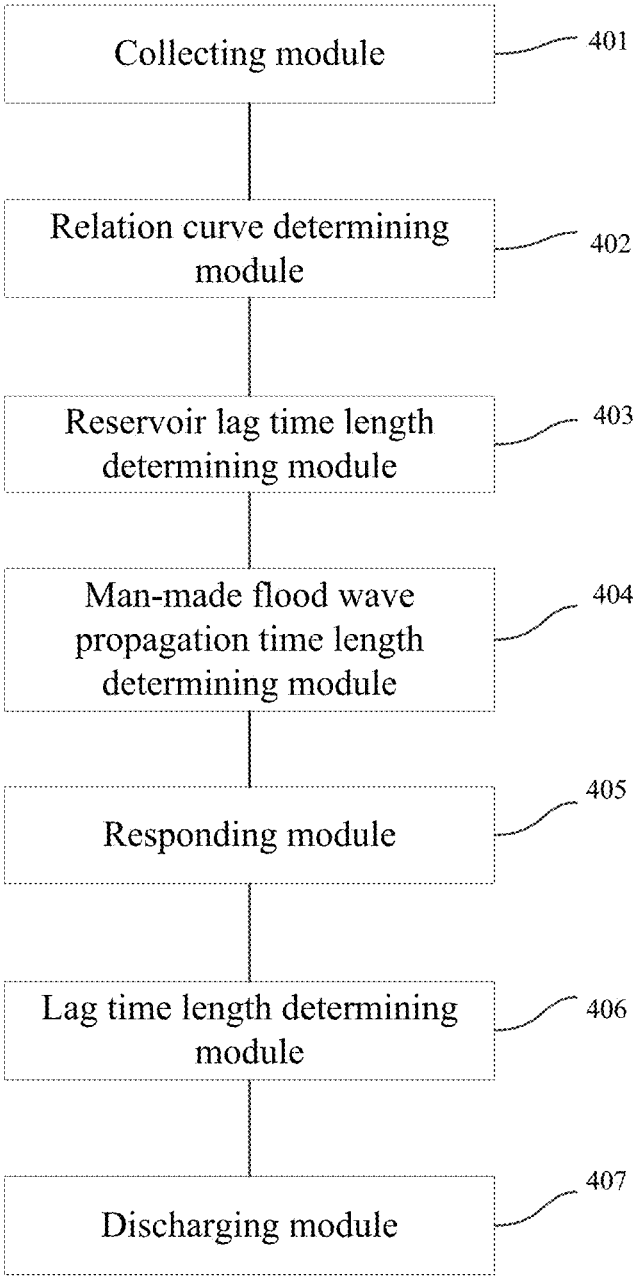
FIG. 4 is a block diagram for a device for optimizing regulation of reservoir sediment discharging based on an asynchronous propagation characteristic between a flood peak and a sediment peak according to an embodiment of the present disclosure.

Referring to FIG. 4, FIG. 4 is a block diagram for a device for optimizing regulation of reservoir sediment discharging based on an asynchronous propagation characteristic between a flood peak and a sediment peak according to an embodiment of the present disclosure. The device includes:

a collecting module 401, which is configured to collect hydrologic features and measured topographic data of tail area of a reservoir, the measured topographic data being used to determine a relation curve between a dam front water depth and a reservoir capacity;

a relation curve determining module 402, which is configured to determine a relation curve between a dam front water depth and a reservoir capacity based on the measured topographic data;

a reservoir lag time length determining module 403, which is configured to determine a time length by which a sediment peak entering in the reservoir is propagated to the front of the dam and a time length by which the sediment peak lags behind a flood peak at the front of the dam of the reservoir according to the relation curve between the dam front water depth and the reservoir capacity as well as the hydrologic features;

a man-made flood wave propagation time length determining module 404, which is configured to determine a relation curve between a sediment peak attenuation rate corresponding to the hydrologic features and a sediment concentration of the sediment peak entering in the reservoir, as well as a time length by which a sediment peak is propagated to the front of the dam; and a responding module 405, which is configured to: acquire a real-time sediment concentration of the sediment peak entering in the reservoir in response to an optimizing regulation instruction, and generate the man-made flood wave based on the time length by which the sediment peak entering in the reservoir is propagated to the front of the dam and the relation curve between the sediment peak attenuation rate and the sediment concentration of the sediment peak entering in the reservoir;

a lag time length determining module 406, which is configured to determine a lag time length based on the time length by which the sediment peak lags behind the flood peak at the front of the dam of the reservoir, the time length by which the sediment peak subjected to the man-made flood wave is propagated to the front of the dam, and the sediment peak attenuation rate; and a discharging module 407, which is configured to discharge the man-made flood wave at a time that is after passing of the flood peak by the lag time length.

In an alternative embodiment, the reservoir lag time length determining module 403 includes:

a time length determining sub-module, which is configured to determine a time length by which the sediment peak lags behind the flood peak at the tail area of the reservoir, a time length by which the flood peak entering in the reservoir propagates to the front of the dam, and a time length by which the sediment peak entering in the reservoir is propagated to the front of the dam according to the hydrologic features and the relation curve between the dam front water depth and the reservoir capacity; and a determining sub-module targeting at a time length by which the sediment peak lags behind the flood peak at the front of the dam of the reservoir, which is configured to determine a time length by which the sediment peak lags behind the flood peak at the front of the dam of the reservoir based on the time length by which the sediment peak lags behind the flood peak at tail area of the reservoir, the time length by which the flood peak entering in the reservoir propagates to the front of the dam, and the time length by which the sediment peak entering in the reservoir is propagated to the front of the dam in combination with an empirical formula regarding the time length by which the sediment peak lags behind the flood peak at the front of the dam of the reservoir.

In an alternative embodiment, the hydrologic features include: a time at which a flood peak entering in the reservoir appears, a flow amount of the flood peak entering in the reservoir, a dam front water depth, a dam front water level elevation, a dam front bottom elevation, a time at which the sediment peak entering in the reservoir appears, a sediment concentration of the sediment peak entering in the reservoir, and a water surface length of the reservoir. The time length determining sub-module includes:

a time length defining unit, which is configured to define a difference between the time at which the flood peak entering in the reservoir appears and the time at which the sediment peak entering in the reservoir appears as the time length by which the sediment peak lags behind the flood peak at tail area of the reservoir;

a determining unit targeting at a time length by which the flood peak entering in the reservoir propagates to the front of the dam, which is configured to determine the time length by which the flood peak entering in the reservoir propagates to the front of the dam based on the water surface length of the reservoir, the dam front water level elevation and the dam front bottom elevation in combination with a preset empirical formula regarding the time length to the front of the dam; and a determining unit targeting at a time length by which the sediment peak entering in the reservoir is propagated to the front of the dam, which is configured to determine the time length by which the sediment peak entering in the reservoir is propagated to the front of the dam based on the time at which the sediment peak entering in the reservoir appears, the sediment concentration of the sediment peak entering in the reservoir, and the dam front water depth in combination with the relation curve between the dam front water depth and the reservoir capacity.

In an alternative embodiment, the determining unit targeting at a time length by which the flood peak entering in the reservoir propagates to the front of the dam includes:

a defining sub-unit, which is configured to define a difference between the dam front water level elevation and the dam front bottom elevation as the dam front water depth; and a determining sub-unit targeting at a time length by which the flood peak entering in the reservoir propagates to the front of the dam, which is configured to determine the time length by which the flood peak entering in the reservoir propagates to the front of the dam based on the dam front water depth and the water surface length of the reservoir in combination with the empirical formula regarding a time length to the front of the dam.

In an alternative embodiment, the hydrologic features further include: a sediment content of the sediment peak of a hydrologic station at tail area of the reservoir, a sediment content of the sediment peak of a hydrologic station in front of the dam, a sediment concentration of the sediment peak entering in the reservoir, a reservoir capacity, and a discharged flow amount of upper-stream cascade reservoirs. The man-made flood wave propagation time length determining module 404 includes:

a sediment peak attenuation rate determining sub-unit, which is configured to determine a sediment peak attenuation rate based on the sediment content of the sediment peak of the hydrologic station at tail area of the reservoir and the sediment content of the sediment peak of the hydrologic station in front of the dam;

a relation curve determining sub-unit, which is configured to determine a relation curve between the sediment peak attenuation rate and the sediment concentration of the sediment peak entering in the reservoir based on a plurality of sediment peak attenuation rates and a plurality of sediment concentration of the sediment peak entering in the reservoir; and a time length defining sub-module, which is configured to define a ratio of the reservoir capacity to a discharged flow amount of upper-stream cascade reservoirs as a time length by which the sediment peak subjected to the man-made flood wave is propagated to the front of the dam.

In an alternative embodiment, the responding module 405 includes:

a sediment peak attenuation degree determining sub-module, which is configured to determine an attenuation degree of the sediment peak under a real-time sediment concentration of the sediment peak entering in the reservoir based on the time length by which the sediment peak entering in the reservoir is propagated to the front of the dam and the relation curve between the sediment peak attenuation rate and the sediment concentration of the sediment peak entering in the reservoir; and a man-made flood wave generating module, which is configured to generate a man-made flood wave based on the attenuation degree of the sediment peak.

An embodiment of the present disclosure further provides an electronic device, which includes a memory and a processor. The memory stores a computer program, and the computer program, when executed by the processor, causes the processor to implement steps of the method for optimizing regulation of reservoir sediment discharging based on an asynchronous propagation characteristic between a flood peak and a sediment peak according to any of the above embodiments.

An embodiment of the present disclosure further provides a computer storage medium which stores a computer program thereon, and the computer program, when executed by a processor, implements steps of the method for optimizing regulation of reservoir sediment discharging based on an asynchronous propagation characteristic between a flood peak and a sediment peak according to any of the above embodiments.

An embodiment of the present disclosure further provides a computer program product which stores a computer program thereon, and the computer program, when executed by a processor, implements steps of the method for optimizing regulation of reservoir sediment discharging based on an asynchronous propagation characteristic between a flood peak and a sediment peak according to any of the above embodiments.

Those skilled in the art can clearly understand that, for the sake of convenience and brevity of description, reference for specific working processes of the above described systems, apparatuses, and units can be made to the related processes in the above described method embodiments, and details are not described any further herein.

In the several embodiments provided by the present disclosure, it should be understood that, the method, apparatus, electronic device, and storage medium disclosed may be implemented by other manners. For example, the above described device embodiment is only schematic. For example, the division of units is only a division of logical functions, and there may other dividing manners in actual implementation. For example, multiple units or components may be combined with or integrated into another system, or some features may be omitted or may not be executed. In addition, the illustrated or discussed mutual coupling or direct coupling or communication connection may be those ones realized via some interfaces, means or units, and may be in electrical, mechanical or other manners.

Units illustrated as separate parts may be or may not be physically separated, and a part shown as a unit may be or may not be a physical unit. That is, the part shown as a unit may be located at a position, or may also be distributed at multiple network units. Some or all of the units may be selected according to actual needs so as to achieve the purpose of the solution of an embodiment.

Besides, respective functional units in respective embodiments of the present embodiment may be integrated in one processing units or exist as separate physical units, or two or more units are integrated in one unit. The above integrated unit may be implemented in the form of hardware, and may also be implemented in the form of a software functional unit.

If the integrated unit is implemented in the form of a software functional unit and is sold or used as a separate product, the integrated unit may be stored in a computer readable storage medium. Based on such understanding, the essence of the technical solution of the present disclosure, which is also the portion contributing to the existing technologies, or all or part of the technical solution may be embodied in the form of a software product. This computer software product is stored in a readable storage medium, and includes several instructions to cause a computer device (which may be a personal computer, a server, a network device, and the like) to implement all or some steps of a method described in respective embodiments of the present disclosure. The above-mentioned readable storage medium includes various mediums that can store program codes such as a USB flash disk, a mobile hard disk drive, a ROM (read-only memory), a RAM (random access memory), a magnetic disk, or an optical disk, and the like.

The above embodiments are only used to explain, rather than limit, the technical solution of the present disclosure. Although the present disclosure has been described in detail in conjunction with the above embodiments, a person of ordinary skills in the art should understand that modifications may still be made to technical solutions recited in the above respective embodiments or that equivalent replacements may still be performed on some of the technical features, and these modifications or replacements do not cause the essence of the related technical solution to depart from the spirit and scope of the technical solutions of respective embodiments of the present disclosure.

What is claimed is:

1. A method for optimizing regulation of reservoir sediment discharging based on an asynchronous propagation characteristic between a flood peak and a sediment peak, comprising:

collecting, by a collecting module, hydrologic features and measured topographic data of tail area of a reservoir;

determining, by a relation curve determining module, a relation curve between a dam front water depth and a reservoir capacity based on the measured topographic data;

determining, by a reservoir lag time length determining module, a time length by which a sediment peak entering in a reservoir is propagated to front of a dam and a time length by which the sediment peak lags behind the flood peak at the front of the dam of the reservoir based on the relation curve between the dam front water depth and the reservoir capacity as well as the hydrologic features;

determining, by a man-made flood wave propagation time length determining module, a relation curve between a sediment peak attenuation rate corresponding to the hydrologic features and a sediment concentration of the sediment peak entering in the reservoir, and a time length by which the sediment peak subjected to a man-made flood wave is propagated to the front of the dam;

acquiring, by a responding module, a real-time sediment concentration of the sediment peak entering in the reservoir in response to an optimizing regulation instruction, and generating the man-made flood wave based on the time length by which the sediment peak entering in the reservoir is propagated to the front of the dam and the relation curve between the sediment peak attenuation rate and the sediment concentration of the sediment peak entering in the reservoir;

determining, by a lag time length determining module, a lag time length based on the time length by which the sediment peak lags behind the flood peak at the front of the dam of the reservoir, the time length by which the sediment peak subjected to the man-made flood wave is propagated to the front of the dam, and the sediment peak attenuation rate; and discharging, by a discharging module, the man-made flood wave at a time that is after passing of the flood peak by the lag time length.

2. The method according to claim 1, wherein determining a time length by which a sediment peak entering in the reservoir is propagated to the front of a dam and a time length by which the sediment peak lags behind the flood peak at the front of the dam of the reservoir based on the relation curve between the dam front water depth and the reservoir capacity as well as the hydrologic features comprises:

determining a time length by which the sediment peak lags behind the flood peak at tail area of the reservoir, a time length by which the flood peak entering in the reservoir propagates to the front of the dam, and a time length by which the sediment peak entering in the reservoir is propagated to the front of the dam according to the hydrologic features and the relation curve between the dam front water depth and the reservoir capacity; and determining the time length by which the sediment peak lags behind the flood peak at the front of the dam of the reservoir based on the time length by which the sediment peak lags behind the flood peak at tail area of the reservoir, the time length by which the flood peak entering in the reservoir propagates to the front of the dam, and the time length by which the sediment peak entering in the reservoir is propagated to the front of the dam in combination with an empirical formula regarding the time length by which the sediment peak lags behind the flood peak at the front of the dam of the reservoir.

3. The method according to claim 2, wherein the hydrologic features include: a time at which a flood peak entering in the reservoir appears, a flow amount of the flood peak entering in the reservoir, a dam front water depth, a dam front water level elevation, a dam front bottom elevation, a time at which a sediment peak entering in the reservoir appears, a sediment concentration of the sediment peak entering in the reservoir, and a water surface length of the reservoir; and determining a time length by which the sediment peak lags behind the flood peak at tail area of the reservoir, a time length by which the flood peak entering in the reservoir propagates to the front of the dam, and a time length by which the sediment peak entering in the reservoir is propagated to the front of the dam according to the hydrologic features and the relation curve between the dam front water depth and the reservoir capacity comprises:

determining the time length by which the sediment peak lags behind the flood peak at tail area of the reservoir based on a difference between the time at which the flood peak entering in the reservoir appears and the time at which the sediment peak entering in the reservoir appears;

determining the time length by which the flood peak entering in the reservoir propagates to the front of the dam based on the water surface length of the reservoir, the dam front water level elevation and the dam front bottom elevation in combination with a preset empirical formula regarding a time length to the front of the dam; and determining the time length by which the sediment peak entering in the reservoir is propagated to the front of the dam based on the time at which the sediment peak entering in the reservoir appears, the sediment concentration of the sediment peak entering in the reservoir, and the dam front water depth in combination with the relation curve between the dam front water depth and the reservoir capacity.

4. The method according to claim 3, wherein determining the time length by which the flood peak entering in the reservoir propagates to the front of the dam based on the water surface length of the reservoir, the dam front water level elevation and the dam front bottom elevation in combination with the preset empirical formula regarding a time length to the front of the dam comprises:

determining the dam front water depth based on a difference between the dam front water level elevation and the dam front bottom elevation; and determining the time length by which the flood peak entering in the reservoir propagates to the front of the dam based on the dam front water depth and the water surface length of the reservoir in combination with the empirical formula regarding a time length to the front of the dam.

5. The method according to claim 1, wherein the hydrologic features further include: a sediment content of a sediment peak of a hydrologic station at tail area of the reservoir, a sediment content of the sediment peak of a hydrologic station in front of the dam, a sediment concentration of the sediment peak entering in the reservoir, a reservoir capacity, and a discharged flow amount of upper-stream cascade reservoirs; and determining the relation curve between a sediment peak attenuation rate corresponding to the hydrologic features and a sediment concentration of the sediment peak entering in the reservoir, and determining the time length by which the sediment peak subjected to the man-made flood wave is propagated to the front of the dam comprises:

determining a sediment peak attenuation rate based on the sediment content of the sediment peak of the hydrologic station at tail area of the reservoir and the sediment content of the sediment peak of the hydrologic station in front of the dam;

determining a relation curve between the sediment peak attenuation rate and the sediment concentration of the sediment peak entering in the reservoir based on a plurality of sediment peak attenuation rates and a plurality of sediment concentration of the sediment peak entering in the reservoir; and determining a time length by which the sediment peak subjected to the man-made flood wave is propagated to the front of the dam based on a ratio of the reservoir capacity to the discharged flow amount of upper-stream cascade reservoirs.

6. The method according to claim 2, wherein acquiring a real-time sediment concentration of the sediment peak entering in the reservoir in response to an optimizing regulation instruction, and generating the man-made flood wave based on the time length by which the sediment peak entering in the reservoir is propagated to the front of the dam and the relation curve between the sediment peak attenuation rate and the sediment concentration of the sediment peak entering in the reservoir comprises:

determining an attenuation degree of the sediment peak under a real-time sediment concentration of the sediment peak entering in the reservoir based on the time length by which the sediment peak entering in the reservoir is propagated to the front of the dam and the relation curve between the sediment peak attenuation rate and the sediment concentration of the sediment peak entering in the reservoir; and generating the man-made flood wave based on the attenuation degree of the sediment peak.

7. A device for optimizing regulation of reservoir sediment discharging based on an asynchronous propagation characteristic between a flood peak and a sediment peak, comprising:

a collecting module, which collects hydrologic features and measured topographic data of tail area of a reservoir;

a relation curve determining module, which determines a relation curve between a dam front water depth and a reservoir capacity based on the measured topographic data;

a reservoir lag time length determining module, which determines a time length by which a sediment peak entering in the reservoir is propagated to the front of a dam and a time length by which the sediment peak lags behind a flood peak at the front of the dam of the reservoir based on the relation curve between the dam front water depth and the reservoir capacity as well as the hydrologic features;

a man-made flood wave propagation time length determining module, which determines a relation curve between a sediment peak attenuation rate corresponding to the hydrologic features and a sediment concentration of the sediment peak entering in the reservoir, and determine a time length by which the sediment peak subjected to a man-made flood wave is propagated to the front of the dam;

a responding module, which acquires a real-time sediment concentration of the sediment peak entering in the reservoir in response to an optimizing regulation instruction, and generate the man-made flood wave based on the time length by which the sediment peak entering in the reservoir is propagated to the front of the dam and the relation curve between the sediment peak attenuation rate and the sediment concentration of the sediment peak entering in the reservoir;

a lag time length determining module, which determines a lag time length based on the time length by which the sediment peak lags behind the flood peak at the front of the dam of the reservoir, the time length by which the sediment peak subjected to the man-made flood wave is propagated to the front of the dam, and the sediment peak attenuation rate; and a discharging module, which discharges the man-made flood wave at a time that is after passing of the flood peak by the lag time length.

8. An electronic device, which comprises a processor and a memory, wherein the memory stores non-transitory computer readable instructions, and the non-transitory computer readable instructions, when executed by the processor, implement a method for optimizing regulation of reservoir sediment discharging based on an asynchronous propagation characteristic between a flood peak and a sediment peak, comprising:

collecting, by a collecting module, hydrologic features and measured topographic data of tail area of a reservoir;

determining, by a relation curve determining module, a relation curve between a dam front water depth and a reservoir capacity based on the measured topographic data;

determining, by a reservoir lag time length determining module, a time length by which a sediment peak entering in a reservoir is propagated to front of a dam and a time length by which the sediment peak lags behind the flood peak at the front of the dam of the reservoir based on the relation curve between the dam front water depth and the reservoir capacity as well as the hydrologic features;

determining, by a man-made flood wave propagation time length determining module, a relation curve between a sediment peak attenuation rate corresponding to the hydrologic features and a sediment concentration of the sediment peak entering in the reservoir, and a time length by which the sediment peak subjected to a man-made flood wave is propagated to the front of the dam;

acquiring, by a responding module, a real-time sediment concentration of the sediment peak entering in the reservoir in response to an optimizing regulation instruction, and generating the man-made flood wave based on the time length by which the sediment peak entering in the reservoir is propagated to the front of the dam and the relation curve between the sediment peak attenuation rate and the sediment concentration of the sediment peak entering in the reservoir;

determining, by a lag time length determining module, a lag time length based on the time length by which the sediment peak lags behind the flood peak at the front of the dam of the reservoir, the time length by which the sediment peak subjected to the man-made flood wave is propagated to the front of the dam, and the sediment peak attenuation rate; and discharging, by a discharging module, the man-made flood wave at a time that is after passing of the flood peak by the lag time length.

9. The electronic device according to claim 8, wherein the non-transitory computer readable instructions, when implementing determining a time length by which a sediment peak entering in the reservoir is propagated to the front of a dam and a time length by which the sediment peak lags behind the flood peak at the front of the dam of the reservoir based on the relation curve between the dam front water depth and the reservoir capacity as well as the hydrologic features, implement steps of:

determining a time length by which the sediment peak lags behind the flood peak at tail area of the reservoir, a time length by which the flood peak entering in the reservoir propagates to the front of the dam, and a time length by which the sediment peak entering in the reservoir is propagated to the front of the dam according to the hydrologic features and the relation curve between the dam front water depth and the reservoir capacity; and determining the time length by which the sediment peak lags behind the flood peak at the front of the dam of the reservoir based on the time length by which the sediment peak lags behind the flood peak at tail area of the reservoir, the time length by which the flood peak entering in the reservoir propagates to the front of the dam, and the time length by which the sediment peak entering in the reservoir is propagated to the front of the dam in combination with an empirical formula regarding the time length by which the sediment peak lags behind the flood peak at the front of the dam of the reservoir.

10. The electronic device according to claim 9, wherein the non-transitory computer readable instructions, when implementing determining a time length by which the sediment peak lags behind the flood peak at tail area of the reservoir, a time length by which the flood peak entering in the reservoir propagates to the front of the dam, and a time length by which the sediment peak entering in the reservoir is propagated to the front of the dam according to the hydrologic features and the relation curve between the dam front water depth and the reservoir capacity, implement steps of:

determining the time length by which the sediment peak lags behind the flood peak at tail area of the reservoir based on a difference between the time at which the flood peak entering in the reservoir appears and the time at which the sediment peak entering in the reservoir appears;

determining the time length by which the flood peak entering in the reservoir propagates to the front of the dam based on the water surface length of the reservoir, the dam front water level elevation and the dam front bottom elevation in combination with a preset empirical formula regarding a time length to the front of the dam; and determining the time length by which the sediment peak entering in the reservoir is propagated to the front of the dam based on the time at which the sediment peak entering in the reservoir appears, the sediment concentration of the sediment peak entering in the reservoir, and the dam front water depth in combination with the relation curve between the dam front water depth and the reservoir capacity.

11. The electronic device according to claim 10, wherein the non-transitory computer readable instructions, when implementing determining the time length by which the flood peak entering in the reservoir propagates to the front of the dam based on the water surface length of the reservoir, the dam front water level elevation and the dam front bottom elevation in combination with the preset empirical formula regarding a time length to the front of the dam, implement steps of:

determining the dam front water depth based on a difference between the dam front water level elevation and the dam front bottom elevation; and determining the time length by which the flood peak entering in the reservoir propagates to the front of the dam based on the dam front water depth and the water surface length of the reservoir in combination with the empirical formula regarding a time length to the front of the dam.

12. The electronic device according to claim 8, wherein the non-transitory computer readable instructions, when implementing determining the relation curve between a sediment peak attenuation rate corresponding to the hydrologic features and a sediment concentration of the sediment peak entering in the reservoir, and determining the time length by which the sediment peak subjected to the man-made flood wave is propagated to the front of the dam, implement steps of:

determining a sediment peak attenuation rate based on the sediment content of the sediment peak of the hydrologic station at tail area of the reservoir and the sediment content of the sediment peak of the hydrologic station in front of the dam;

determining a relation curve between the sediment peak attenuation rate and the sediment concentration of the sediment peak entering in the reservoir based on a plurality of sediment peak attenuation rates and a plurality of sediment concentration of the sediment peak entering in the reservoir; and determining a time length by which the sediment peak subjected to the man-made flood wave is propagated to the front of the dam based on a ratio of the reservoir capacity to the discharged flow amount of upper-stream cascade reservoirs.

13. The electronic device according to claim 9, wherein the non-transitory computer readable instructions, when implementing acquiring a real-time sediment concentration of the sediment peak entering in the reservoir in response to an optimizing regulation instruction, and generating the man-made flood wave based on the time length by which the sediment peak entering in the reservoir is propagated to the front of the dam and the relation curve between the sediment peak attenuation rate and the sediment concentration of the sediment peak entering in the reservoir, implement steps of:

determining an attenuation degree of the sediment peak under a real-time sediment concentration of the sediment peak entering in the reservoir based on the time length by which the sediment peak entering in the reservoir is propagated to the front of the dam and the relation curve between the sediment peak attenuation rate and the sediment concentration of the sediment peak entering in the reservoir; and generating the man-made flood wave based on the attenuation degree of the sediment peak.

* * * * *